US011498790B2

(12) United States Patent
Koch et al.

(10) Patent No.: US 11,498,790 B2
(45) Date of Patent: Nov. 15, 2022

(54) SHEET-PROCESSING MACHINE COMPRISING A TURNING DEVICE, METHOD FOR CONVEYING SHEETS, AND USE OF SHEET GUIDE ELEMENTS CONTAINING DEIONIZATION DEVICES

(71) Applicant: KOENIG & BAUER AG, Würzburg (DE)

(72) Inventors: Heinz Michael Koch, Dresden-Cossebaude (DE); Mario Herzog, Coswig (DE); Tilo Hanke, Dresden (DE); Dietmar Lange, Dresden (DE); Michael Geihsler, Kesselsdorf (DE)

(73) Assignee: KOENIG & BAUER AG, Würzburg (DE)

( * ) Notice: Subject to any disclaimer, the term of this patent is extended or adjusted under 35 U.S.C. 154(b) by 0 days.

(21) Appl. No.: 17/615,168

(22) PCT Filed: Jun. 2, 2020

(86) PCT No.: PCT/EP2020/065174
§ 371 (c)(1),
(2) Date: Nov. 30, 2021

(87) PCT Pub. No.: WO2021/004696
PCT Pub. Date: Jan. 14, 2021

(65) Prior Publication Data

US 2022/0204295 A1 Jun. 30, 2022

(30) Foreign Application Priority Data

Jul. 9, 2019 (DE) ..... 10 2019 118 568.8

(51) Int. Cl.
*B65H 15/00* (2006.01)
*B41F 21/10* (2006.01)
(Continued)

(52) U.S. Cl.
CPC ..... *B65H 15/00* (2013.01); *B41F 15/0809* (2013.01); *B41F 21/106* (2013.01);
(Continued)

(58) Field of Classification Search
CPC .. B65H 15/00; B65H 5/38; B65H 2301/5133; B65H 2801/21; B41F 21/106; B41J 13/223
See application file for complete search history.

(56) References Cited

U.S. PATENT DOCUMENTS

2002/0043758 A1 4/2002 Keim et al.
2006/0150841 A1* 7/2006 Bachmeier ..... B65H 29/52 101/232

FOREIGN PATENT DOCUMENTS

CN 1441725 A 9/2003
CN 1944048 A 4/2007
(Continued)

OTHER PUBLICATIONS

Chinese Office Action received in corresponding Chinese Application No. 202080039607.4 dated Mar. 18, 2022.
(Continued)

*Primary Examiner* — Jeremy R Severson
(74) *Attorney, Agent, or Firm* — Mattingly & Malur, PC

(57) ABSTRACT

A sheet-processing machine includes a turning device. Sheets can be conveyed, by a sheet conveyor system, from a sheet guide cylinder in the turning device, and can be conveyed in a sheet conveyor direction on a sheet conveyor path. A sheet guide element is provided beneath or along the sheet conveyor path. A deionization device is assigned to the sheet guide element. The deionization device can provide positive and negative ions.

15 Claims, 10 Drawing Sheets

(51) Int. Cl.

| | |
|---|---|
| ***B41J 13/22*** | (2006.01) |
| ***B65H 5/38*** | (2006.01) |
| ***B41F 15/08*** | (2006.01) |
| *B41J 3/60* | (2006.01) |

(52) U.S. Cl.
CPC ..... *B41J 13/223* (2013.01); *B65H 5/38* (2013.01); *B41J 3/60* (2013.01); *B65H 2301/5133* (2013.01); *B65H 2406/11* (2013.01); *B65H 2801/21* (2013.01)

(56) References Cited

FOREIGN PATENT DOCUMENTS

| | | | |
|---|---|---|---|
| CN | 107835747 | A | 3/2018 |
| DE | 19755745 | A1 | 6/1999 |
| DE | 10038774 | A1 | 12/2001 |
| DE | 10056018 | A1 | 5/2002 |
| DE | 102007049643 | A1 | 5/2008 |
| DE | 102008001165 | A1 | 10/2009 |
| DE | 102010028702 | A1 | 11/2011 |
| EP | 0306682 | A2 | 3/1989 |
| EP | 1155834 | A2 | 11/2001 |
| EP | 1679187 | B1 | 7/2006 |
| JP | 2004-4336 | A | 1/2004 |
| JP | 2006-188065 | A | 7/2006 |
| JP | 3889503 | B2 | 3/2007 |
| JP | 2008-7314 | A | 1/2008 |
| JP | 2018-10721 | A | 1/2018 |
| JP | 2018-99898 | A | 6/2018 |

OTHER PUBLICATIONS

International Search Report of PCT/EP2020/065174 dated Sep. 8, 2020.

Japanese Office Action received in corresponding Japanese Office Action received in corresponding Japanese Application No. 2021-570840 dated Jun. 13, 2022.

Chinese Office Action received in corresponding Chinese Application No. 202080039607.4 dated Jun. 24, 2022.

* cited by examiner

SHEET-PROCESSING MACHINE COMPRISING A TURNING DEVICE, METHOD FOR CONVEYING SHEETS, AND USE OF SHEET GUIDE ELEMENTS CONTAINING DEIONIZATION DEVICES

CROSS-REFERENCE TO RELATED APPLICATIONS

This application is the US national phase, under 35 USC § 371, of PCT/EP2020/065174, filed Jun. 2, 2020; published as WO 2021/004696 A1 on Jan. 14, 2021, and claiming priority to DE 10 2019 118 568.8, filed Jul. 9, 2019, the disclosures of which are expressly incorporated herein, in their entireties, by reference.

FIELD OF THE INVENTION

The present invention relates to a sheet-processing machine comprising a turning device, to a method for conveying sheets, in particular in a turning device of a sheet-processing machine, and to the use of a sheet guide element containing a deionization device in a sheet-processing machine, in particular a turning device of a sheet-processing machine.

BACKGROUND OF THE INVENTION

In sheet printing presses, for example, an increased electrostatic charge of the sheets can occur in particular in printing units, especially at high speeds. In the printing units, this causes a printed sheet to be drawn to the succeeding sheet guide plates as a result of the charge, despite air cushions that are introduced, and smearing of the fresh ink to occur on the underside of the sheet guide plates.

Increased electrostatic charging of the sheets can also occur in the turning zone, especially at high speeds. The sheets consequently enter the cylinder gap between the turning drum/impression cylinder or the later printing zone in a rippled manner. The sheet can no longer slide on the impression cylinder surface during a smoothing operation and becomes folded.

A device for conveying sheets through the printing zone of the blanket cylinder and the impression cylinder of a sheet rotary printing press is known from EP 0 306 682 A2, wherein deionization rods are arranged upstream from the two ionization rods that generate opposite charges for neutralizing the sheets, which are directed at the sheet from beneath or from above, wherein both are fed, for example, a suitable alternating voltage. This neutralization of the charges creates unambiguous starting conditions for the later positive charge of the sheet. To eliminate the force fit between the sheets and a cover, a further deionization rod is arranged just upstream from the transfer point of the printed sheet to the gripper systems of the sheet removal drum. The arrangement is relatively complex and increases the adhesion of the sheets on the cylinder.

A device for removing electric charges from flat material is known from EP 1 155 834 A2, wherein the positive charge of a printed material lying on a metal plate is compensated for by means of first ionizing tips. Due to the remaining negative charge on the underside of the printed material, the printed material, with the discharged surface, becomes nestled against a further metal plate, wherein the negative charge is compensated for by the downstream ionization rod. This complex system is not suitable for sheet guide elements in sheet-processing machines, in particular in turning devices of sheet-processing machines.

A sheet guide device comprising an electrically insulated, comb-shaped edge is known from EP 1 679 187 B1 or US 2006/150841 A1, wherein a discharging device for discharging the printing material sheets is arranged in the region of the edge. The arrangement in the edge close to the impression cylinder leads to a decreased effect. The edge made of non-conducting material is subject to increased wear, especially in the critical area of the sheet receiving zone, and causes decreased stability in the event of a crash. Furthermore, the arrangement of the discharging device in the concentric guide path makes it more difficult to maintain the optimal electrode spacing, resulting in a decreased effect.

A device for electrostatically influencing signatures is known from DE 197 55 745 A1, wherein a flat charging electrode is applied to the guide surface of a sheet guide plate. The device is intended to draw the sheets onto the sheet guide plate due to the attraction effect and to hold them in a floating state by way of a blower air stream. In reality, a stable floating height of the sheets cannot be maintained at a constant level by such a device. In addition, the flat charging electrode interferes with the nozzle distribution, which has to be configured in accordance with the need for sheet support.

A fan unit in a printing press is known from DE 100 38 774 A1, which comprises controllable ionic fans. In a sheet turning device as well, a printing substrate sheet can thus be guided adhering to the turning drum and turned through the use of generated negative pressure. For this purpose, ionic fan-containing fan units can be integrated within a cylinder or into its surface. This is a complex process, which is also not sufficiently effective.

A device for turning a sheet, while it is conveyed through a printing press, is known from DE 10 2007 049 643 A1, wherein a deceleration system for a sheet is fixed to the stand. The brake system is composed of a generator for an alternating magnetic field and a pneumatic guide device for the sheet. When the sheet passes the generator, a current is to be induced in the ferromagnetic material of the sheet or the printing ink on the sheet. A magnetic field originating from the eddy current is to counteract the field of the generator, so that the sheet is decelerated. The effect of this principle is questionable. The sheets are also not discharged because the generator does not emit any ions.

A turning device of a sheet printing press is known from DE 10 2010 028 702 A1, wherein an ionization device is assigned to the sheet transport path at or in connection with a storage drum, wherein the sheets that are guided on the storage drum or fed to the storage drum can be supplied with electric charges.

DE 100 56 018 A1 shows a device for supporting sheet guidance and sheet stacking, wherein a sheet guide element blowing blower air in the interior encloses a deionization device.

DE 10 2008 001 165 A1 shows a sheet-guiding cylinder of a processing machine, wherein the cylinder comprises a main body on which a cylinder shell that is electrically insulated with respect thereto is arranged.

SUMMARY OF THE INVENTION

It is the object of the present invention to devise an alternative sheet-processing machine and an alternative method for conveying sheets in a sheet-processing machine, and to improve sheet guidance in general in a sheet-processing machine, in particular in a turning device of a sheet-processing machine. In particular, reliable sheet guidance is to be improved, especially in the region of a turning device, in particular in the case of low grammage or foil sheets.

According to the present invention, the object is achieved by the features of an independent claim. Advantageous embodiments result from the dependent claims, the description, and the drawings. At this point, all embodiments of the invention disclosed in the claims of the documents as originally filed are explicitly incorporated by reference in the description.

The invention has the advantage that an alternative sheet-processing machine and an alternative method for conveying sheets in a sheet-processing machine are devised. In particular, sheet guidance is further improved, especially in the region of a turning device, which can advantageously result in a considerable increase in performance of a sheet-processing machine, for example a sheet printing press, in particular a sheet offset printing press.

Particularly preferably, deionization of a sheet can be achieved after the sheet has been released from a sheet guide cylinder, in particular from a storage drum in a turning device. The machine can be suitable or configured for processing sheets of low grammage and/or for processing foil sheets. The machine can process, in particular print and/or coat, sheet material having a grammage of more than 250 g/m$^2$, preferably, however, of less than 250 g/m$^2$, particularly preferably of less than 150 g/m$^2$, and most particularly preferably of less than 80 g/m$^2$. Preferably, one, two or more discharge electrodes can be arranged in the region of the sheet guide element, in particular of a sheet guide plate of a turning device. The arrangement can be carried out in the form of a cassette. For example, one or more discharge electrodes can be placed onto the sheet guide plate, or one or more discharge electrodes can be recessed into the sheet guide plate. Electrodes that are recessed are preferably in each case positioned between insulators, whose surfaces terminate in particular tangentially at the sheet guide plate.

The sheet guide element, in particular the sheet guide plate, preferably downwardly delimits the long side of a turning zone of a turning device. The sheet guide element, in particular the sheet guide plate, is preferably spaced apart from the cylinder tangent between a storage drum and a turning drum in such a way that the distance with respect to the sheet corresponds to the optimal electrode spacing. Furthermore, a device, in particular a tautening sucker, can be provided on the storage drum, which additionally tightens or tautens the sheet in the vicinity of the cylinder tangent between the storage drum and the turning drum, so that not only the optimal electrode spacing is preserved across the full sheet length, but also that the sheet can be influenced where, on the upper side and underside, it remains free of ion-binding contact with machine parts with mass, so that the ions are able to transition with little impediment into the activated deionizing ambient air, which ultimately results in a maximally possible discharging of the sheets.

A discharge cassette is preferably introduced into the sheet guide element, in particular the sheet guide plate, while turning the sheets so as to discharge the sheets. A discharged sheet is thus freed from electrostatic force actions and can be smoothed so as to be able to pass a downstream processing station or printing zone without ripples and without creases.

It is useful in machines that include turning devices, especially when processing print substrates having low grammage or made of foil material, to provide deionization devices in further, or preferably all, printing units and possible further units and/or a delivery, in addition to the deionization device in the turning device, since the print substrate is always recharged in a printing zone. Preferably, sheet guide elements that contain deionization devices configured as sheet guide plates are used for this purpose, which, arranged at a suitable distance with respect to the sheet conveyor path, particularly advantageously ensure optimal discharge and guidance of the printing materials at the same time.

BRIEF DESCRIPTION OF THE DRAWINGS

The invention shall be described hereafter by way of example. The associated drawings schematic show.

DESCRIPTION OF THE PREFERRED EMBODIMENT

Figure 1:
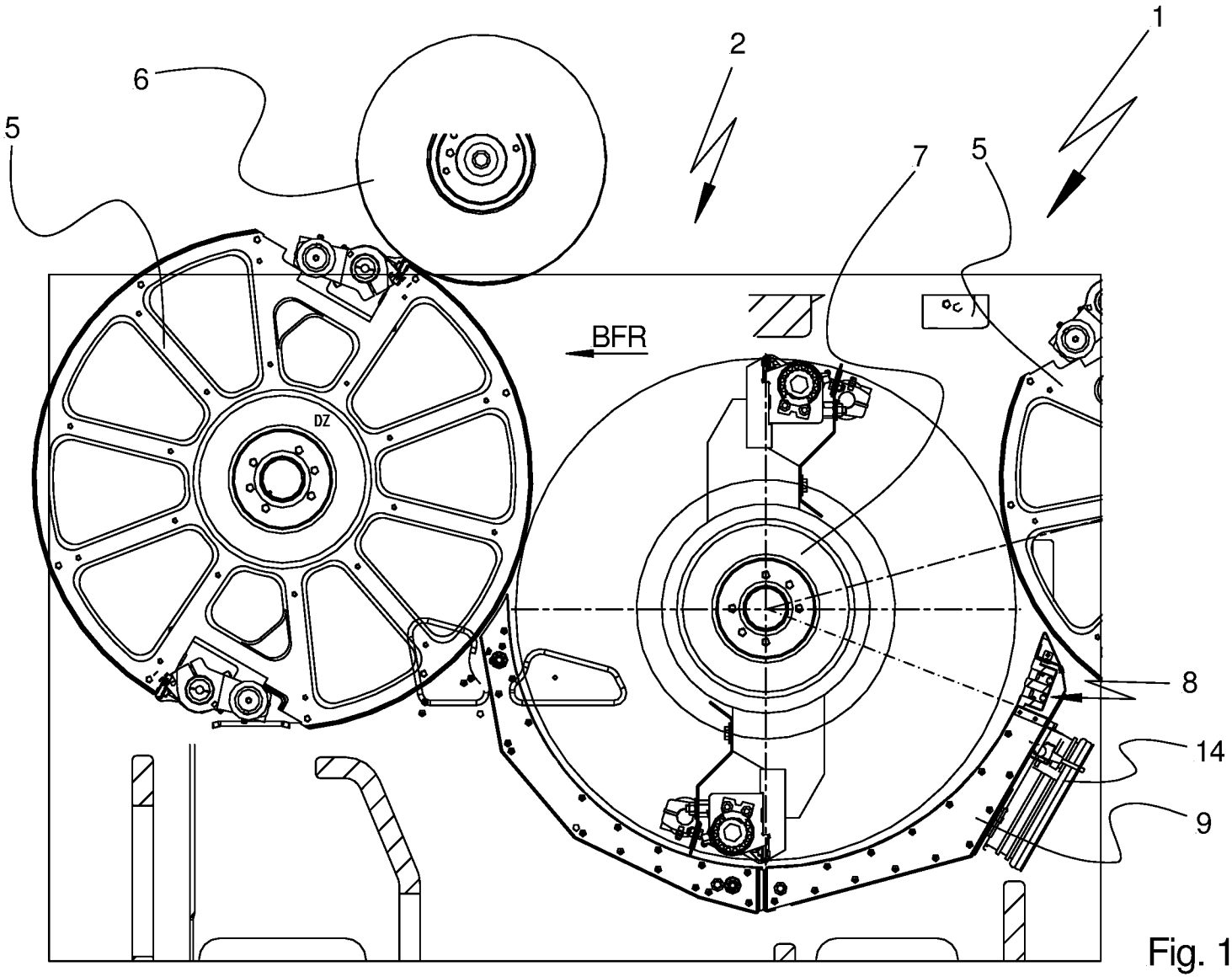
FIG. 1: shows a section of a sheet-processing machine comprising a sheet guide element that is assigned to a sheet conveyor system of a printing unit.

FIG. 1, by way of example, shows a section of a sheet-processing machine 1, in particular of a sheet printing press, here specifically of a sheet offset rotary printing press, preferably in a unit-based and an inline configuration, in particular for foil sheet processing. In a preferred embodiment, the machine 1 is a foil sheet-processing machine, in particular equipped accordingly. An offset printing press can be operated accordingly using the offset process, however other printing methods, such as screen printing, ink jet and the like, can also be used in the machine 1. The machine 1 includes an arbitrary number of sheet-processing units, which can be embodied, for example, as infeed, primer, printing, coating, drying, inspection and/or finishing units, for example as an inline processing unit. In the unit-based and inline configurations, the consecutively arranged units of the machine 1 are preferably embodied to be substantially identical, wherein, for example, identical substructure modules can be used. The machine 1 can furthermore include a feeder for feeding sheets or a discharge device for discharging the processed sheets. Furthermore, the machine 1 could also comprise inline processing devices and/or also one or more inline processing units that, for example, can be embodied as a foil finishing unit, cold foil units, calendering unit, die-cutting unit, numbering unit, screen printing unit, perforating unit, stamping unit and the like. In particular, a turning device 3 is arranged between two units of the machine 1, by way of which the sheets can be turned in a recto and verso printing operating mode. The machine 1 is preferably embodied to be switchable between the recto printing and the recto and verso printing operating modes.

The machine 1 in particular includes at least two or a multiplicity of printing units 2 and/or one or more coating units for processing sheets. Each of the printing units 2 of the machine 1 preferably comprises a transfer cylinder or blanket cylinder 6 and a forme cylinder or plate cylinder, which is not shown in detail. A blanket cylinder 6 of a printing unit 2 cooperates with a respective sheet guide cylinder, in particular an impression cylinder 5. A sheet conveyor system, preferably a sheet conveyor drum 7 or a transfer drum or a transfer cylinder, is provided between two sheet guide cylinders, in particular impression cylinders 5. The impression cylinders 5 and the sheet conveyor drum 7 here have a double-sized configuration, and the blanket cylinders 6 and the plate cylinders have a single-sized configuration. Single-sized cylinders can approximately receive one maximum-format sheet, and double-sized cylinders can approximately receive two maximum-format sheets simultaneously around the circumference. In an alternative embodiment, the sheet guide cylinders, in particular the impression cylinders 5 or the transfer drums, could also have a single-sized, triple-sized or larger configuration.

The double-sized impression cylinders 5 or the sheet conveyor drum 7 here preferably each comprise two gripper systems for fixing sheets to be conveyed, in particular foil sheets. These gripper systems, which are arranged diametrically opposed, for example in gripper channels, hold the sheet to be processed for conveyance. The gripper systems preferably comprise stationary gripper pads, which cooperate with gripper fingers that can be moved, for example, by means of radial cams and cam rollers via roller levers, for clamping the sheets. During their respective rotation, the gripper pads of the impression cylinder 5 and of the sheet conveyor drum 7 describe a gripper pad path, which substantially corresponds to the sheet conveyor path. During conveyance, the sheets can rest on the respective cylinder or the cylinder lateral surface of a sheet guide cylinder, in particular of an impression cylinder 5. The sheets are transferred between the sheet guide cylinders, in particular the impression cylinders 5, and the sheet conveyor systems, in particular the sheet conveyor drums 7, of the printing units 2 of the machine 1, preferably in a gripper closure. A delivery 4 comprising a delivery chain loop is preferably arranged downstream from the last unit of the machine 1, the loop receiving the sheets from the last sheet guide cylinder, in particular an impression cylinder 5, by means of gripper carriages and conveying them to a delivery pile. For example, a last unit of the machine 1 upstream from the delivery 4 can be embodied as a printing, coating, drying, inspection or finishing unit, such as an inline processing unit.

In the printing units 2 of the machine 1, the blanket cylinders 6 are functionally connected to the plate cylinders and known inking or inking and dampening units are arranged, which apply the corresponding printing ink onto a printing plate that is clamped on the respective plate cylinder. During its rotation, a plate cylinder is inked by at least one roller, but preferably multiple rollers of the assigned inking unit or inking and dampening unit. When the plate cylinder carries out a rolling motion on the blanket cylinder 6, the printing ink is transferred to the blanket cylinder 6 containing a rubber printing blanket in accordance with the motif. A press nip or a printing zone is formed between a blanket cylinder 6 and an impression cylinder 5, through which the sheet to be printed is conveyed from the impression cylinder 5 by means of the gripper systems. In the press nip, the printing ink is transferred from the blanket cylinder 6 to the sheet in accordance with the motif. The impression cylinder 5 in particular has a lateral surface, extending over the entire surface area, for supporting the sheets to be conveyed, which forms the press nip with the rubber printing blanket of the blanket cylinder 6. A plate cylinder and a blanket cylinder 6 of a respective printing unit 2 of the machine 1 preferably comprise a respective cylinder pin on each side, by way of which the cylinders are rotatably mounted in the stand of the respective printing unit 2. Both the plate cylinders and the blanket cylinders 6 preferably each have bearer rings, which are arranged on both sides and not shown. The plate cylinder bearer rings are in contact with the blanket cylinder bearer rings during the printing process and carry out a rolling motion on one another under pressure. The bearer rings are preferably dimensioned in such a way that, during printing operation, no noteworthy transfer of moment occurs between the cylinders, i.e., no predetermined moment is transferred via the bearer rings.

The machine 1 preferably comprises a drive wheel train, which particularly preferably, as a continuous drive gear wheel train, drives the sheet guide cylinders, in particular the impression cylinders 5 of the printing units 2. The sheet conveyor systems, in particular the sheet conveyor drums 7 or transfer drums, are preferably also driven by the drive wheel train. For this purpose, the impression cylinders 5 and the sheet conveyor drums 7 in each case comprise gear wheels that mesh with one another and form the drive wheel train. The drive wheel train is driven by at least one main drive motor, which provides the drive input centrally or preferably in the region of the forward units of the machine 1. For example, the drive input of the main drive motor can take place in the first printing unit 2 directly following the infeed unit in the sheet conveyor direction BFR, in particular to the gear wheel that is assigned to the shaft of the first impression cylinder 5. The cylinders or drums are driven about their respective axis of rotation by the continuous drive wheel train. The blanket cylinders 6 of the printing units 2 are also preferably driven starting from the drive wheel train. Further rotary bodies or rollers of the machine 1 or of the printing units 2 can likewise be at least temporarily driven by the drive wheel train, wherein these can also be designed to be couplable to the drive wheel train.

For example, a dedicated drive, in particular a plate cylinder direct drive, can be assigned to one or each plate cylinder of a printing unit 2. Direct drives are in particular dedicated drives whose rotors are attached so as to be aligned and concentric, preferably directly with respect to the assigned cylinders. During printing, the plate cylinder in question can then trail the blanket cylinder 6, which is preferably driven by the main drive motor via the drive wheel train, in an electronically synchronized manner. For this purpose, a rotary encoder, which can be connected to a quality control device, a control unit of the printing unit 2 and/or the machine controller, can be assigned to the plate cylinder and/or the blanket cylinder 6. As an alternative, the plate cylinder or plate cylinders, however, can also be driven via the drive wheel train starting from the main drive motor, for example by way of couplings.

In the case of a foil sheet-processing machine 1, foil material-containing sheet substrate or sheet substrate made of foil material is processed, in particular printed and/or coated. The sheet-processing machine 1 comprises in particular suitable equipment for processing foil sheets. The foil sheet-processing machine is preferably embodied as a foil sheet printing press, at least for printing foil sheets. In particular, the machine 1 can comprise a foil sheet processing package, which is specifically matched to the foil material. For example, the machine 1 can comprise at least one primer unit arranged upstream from the printing units 2, for example, and/or a special double-sheet detector unit and/or the gripper systems of the machine 1 can be matched to the thin nature of the foil sheet material and/or printing inks and/or coating materials or dryers that are used can be matched to the foil material. Foil material can be foils made of PVC, PP, PS, PET, for example. Furthermore, however, specialty papers, laminated papers or paperboards could also be processed by a machine 1.

In particular during foil printing, the foil sheets are charged in every active printing unit 2 of the machine 1. The foil sheets in particular undergo renewed extreme static re-charging with each printing process. In particular, deionization devices 8 are therefore provided at least in the printing units 2 and/or coating units of the machine 1, which are arranged downstream from the press nip of the first printing units 2 of the machine 1 with respect to the sheet conveyor direction BFR. Deionization devices 8 are preferably provided in all units of the machine 1 that are arranged downstream from the first printing unit 2. However, in a refinement, it is also possible for a deionization device 8 to be assigned to an infeed unit and/or the first printing unit 2 of the machine 1. The deionization devices 8 are in particular provided in each printing unit 2 and/or coating unit of the machine 1, wherein in particular one deionization device 8 is exclusively arranged in each printing unit 2 and/or coating unit. More preferably, such a deionization device 8 is also provided in each case in one or each additional unit, such as a coating, drying, inspection or finishing unit. Charging devices for deliberately charging cylinders or sheets are in particular not provided.

The sheets, in particular the foil sheets, are conveyed or transported along a sheet conveyor path by the sheet guide cylinders, in particular the impression cylinders 5, and the sheet conveyor systems, in particular the sheet conveyor drums 7, of the machine 1. In the process, in particular beneath and along the sheet conveyor path, a sheet guide element, which begins in the region of the sheet guide cylinder, in particular of the impression cylinder 5, is provided in one or all printing units 2. Such a sheet guide element is preferably configured as an in particular metallic sheet guide plate 9, which extends in particular across the machine width. In particular, such a sheet guide plate 9 comprises comb fingers 10 in the region facing the sheet guide cylinder, in particular the impression cylinder 5. With respect to the sheet conveyor direction BFR, in particular a respective deionization device 8 adjoins the comb fingers 10, wherein the comb fingers 10 of the sheet guide plate 9 are made in particular partially or completely of metallic material. Furthermore, the comb-shaped regions of the sheet guide elements could be provided with blower air openings and, in particular, be switchable to blower air, so that a force that acts pneumatically on the sheets can be generated in these regions. In particular, the sheets, in particular the foil sheets, could thus be peeled off the lateral surface of the upstream sheet guide cylinder, in particular the impression cylinder 5, by the pneumatically acting comb fingers 10. The sheet guide surfaces of the comb fingers 10 are thus assigned to blower air openings to which overpressure can be applied. In particular, a blower air action is exerted by the overpressure, which exceeds the ambient pressure, on the sheets that are conveyed along the sheet conveyor path.

A sheet guide element, in particular a sheet guide plate 9, beneath a sheet conveyor system, in particular a sheet conveyor drum 7, can be composed of a single-piece metal sheet or of multiple segments. For example, an upstream guide piece can form a first region, and a downstream guide piece can form a second region for sheet guidance. In the process, for example, a first segment or partial plate can extend from the shell of the sheet guide cylinder, in particular of the impression cylinder 5, to perpendicularly beneath the axis of rotation of the sheet conveyor drum 7. A second segment or partial plate can adjoin in the sheet conveyor direction BFR and extend to the lateral surface of the downstream sheet guide cylinder, in particular the impression cylinder 5. A deionization device 8 is in particular assigned to the first segment of the sheet guide element. In particular, the deionization device 8 is assigned to the sheet guide element, or the sheet guide surface of the sheet guide element, in the region of the upstream sheet guide cylinder, in particular the impression cylinder 5. Particularly preferably, the deionization device 8 forms the sheet guide surface in its arrangement region.

In particular, the segment arranged downstream with respect to the sheet conveyor direction BFR, or a second region of the sheet guide element, in particular of the sheet guide plate 9, is concentrically configured with respect to the axis of rotation of the sheet conveyor system, in particular the sheet conveyor drum 7. In particular, the sheet guide surface of the second segment of the sheet guide element, in particular of the sheet guide plate 9, is concentrically configured about the axis of rotation or the gripper pad path of the sheet conveyor drum 7. The first segment of the sheet guide element, in particular of the sheet guide plate 9, can include a sheet guide surface that steadily approaches the axis of rotation of the sheet conveyor system, in particular of the sheet conveyor drum 7, in or starting in the region of the sheet guide cylinder, in particular of the impression cylinder 5. The sheet guide element thus has a spiral-shaped configuration. The first segment can also be concentrically configured about an axis that is spaced apart from the axis of rotation of the sheet conveyor drum 7.

In particular, at least one fan 14, which can in particular be activated for generating blower and/or suction air, can be assigned to a sheet guide element, in particular a sheet guide plate 9. A fan 14 is preferably arranged at the sheet guide element, in particular at a sheet guide plate 9, so as to generate blower and/or suction air in the region of the sheet guide surface of the sheet guide element, in particular of the sheet guide plate 9. In particular, corresponding openings, for example Venturi nozzles, facing the sheet conveyor path, are assigned to the sheet guide element, in particular to the sheet guide plate 9. Outside potentially provided openings, however, the sheet guide element, in particular the sheet guide plate 9, preferably has a closed sheet guide surface.

In particular, a sheet guide element, in particular a sheet guide plate 9, can be configured in such a way that a sheet guide surface extends, starting in the region of the lateral surface of the sheet guide cylinder, in particular of the impression cylinder 5, to the downstream sheet guide cylinder, in particular the impression cylinder 5, beneath the sheet conveyor system, in particular the sheet conveyor drum 7. A first region of the sheet guide element, in particular of the sheet guide plate 9, which starts in the region of the upstream sheet guide cylinder, in particular of the impression cylinder 5, can comprise the comb fingers 10 and be spaced further apart from the axis of rotation of the sheet conveyor system, in particular of the sheet conveyor drum 7, than a succeeding second region of the sheet guide element, in particular of the sheet guide plate 9. The comb fingers 10 and the first region of the sheet guide plate 9 preferably form a substantially closed sheet guide surface for the sheets.

The first region of the sheet guide plate 9 can start in an angle of rotation range of the sheet conveyor drum 7 that is spaced between 15° and 25°, in particular approximately 20°, apart from the transfer center line formed by the gripper closure between the upstream impression cylinder 5 and the sheet conveyor drum 7. The sheet guide plate 9 or the comb fingers 10 can be arranged at a distance of, for example, 2 mm to 50 mm, in particular between 25 mm and 30 mm, from the sheet conveyor path formed by gripper pads of the sheet conveyor drum 7. The first region of the sheet guide plate 9 preferably steadily approaches the axis of rotation of the sheet conveyor drum 7 or the sheet conveyor path.

In a second region of the sheet guide plate 9 adjoining the first region of the sheet guide plate 9 in the sheet conveyor direction BFR, the sheets are preferably concentrically guided with respect to the axis of rotation of the sheet conveyor drum 7, or they are guided parallel to the gripper pad path of the sheet conveyor drum 7 or parallel to the sheet conveyor path. The second region of the sheet guide plate 9 can, for example, be configured to be spaced 5 mm to 10 mm apart from the sheet conveyor path. The second region of the sheet guide plate 9 can, for example, start in an angle of rotation range of 60° to 90° spaced apart from the transfer center line between the impression cylinder 5 and the sheet conveyor drum 7. The sheet guide element, in particular the sheet guide plate 9, can thus be configured in such a way that a distance between its first upstream region with respect to the sheet conveyor direction BFR and the gripper pad path or the sheet conveyor path is several times, for example twice or three times, as large compared to that of the downstream second region.

A deionization device 8 is preferably arranged in the first region of the sheet guide plate 9, wherein it is arranged downstream from the comb fingers 10 in the sheet conveyor direction BFR if comb fingers 10 are provided. Comb fingers 10 can, for example, extend over an angle of rotation range of the sheet conveyor drum 7 of approximately 5°. A deionization device 8 can directly adjoin the comb fingers 10 or extend over an angle of rotation range of the sheet conveyor drum 7 of at least approximately 10°. The sheet guide surface of the sheet guide plate 9 formed by the comb fingers 10 and/or the deionization device 8 approaches, in particular steadily, the axis of rotation of the sheet conveyor drum 7, or its gripper pad path, or the sheet conveyor path, as viewed in the sheet conveyor direction BFR. For example, the first region of the sheet guide plate 9 can transition into the second region, which is configured to be substantially concentric with respect to the sheet conveyor path, within an angle of rotation range of the sheet conveyor drum 7 of, for example, approximately 60°. The machine 1 can comprise further units or printing units 2, wherein some, or preferably all, of the units or printing units 2 include or contain sheet guide elements, in particular sheet guide plates 9, for guiding sheets. The sheet guide elements, in particular the sheet guide plates 9, of the machine 1 are in particular configured to be identical.

Figure 2:
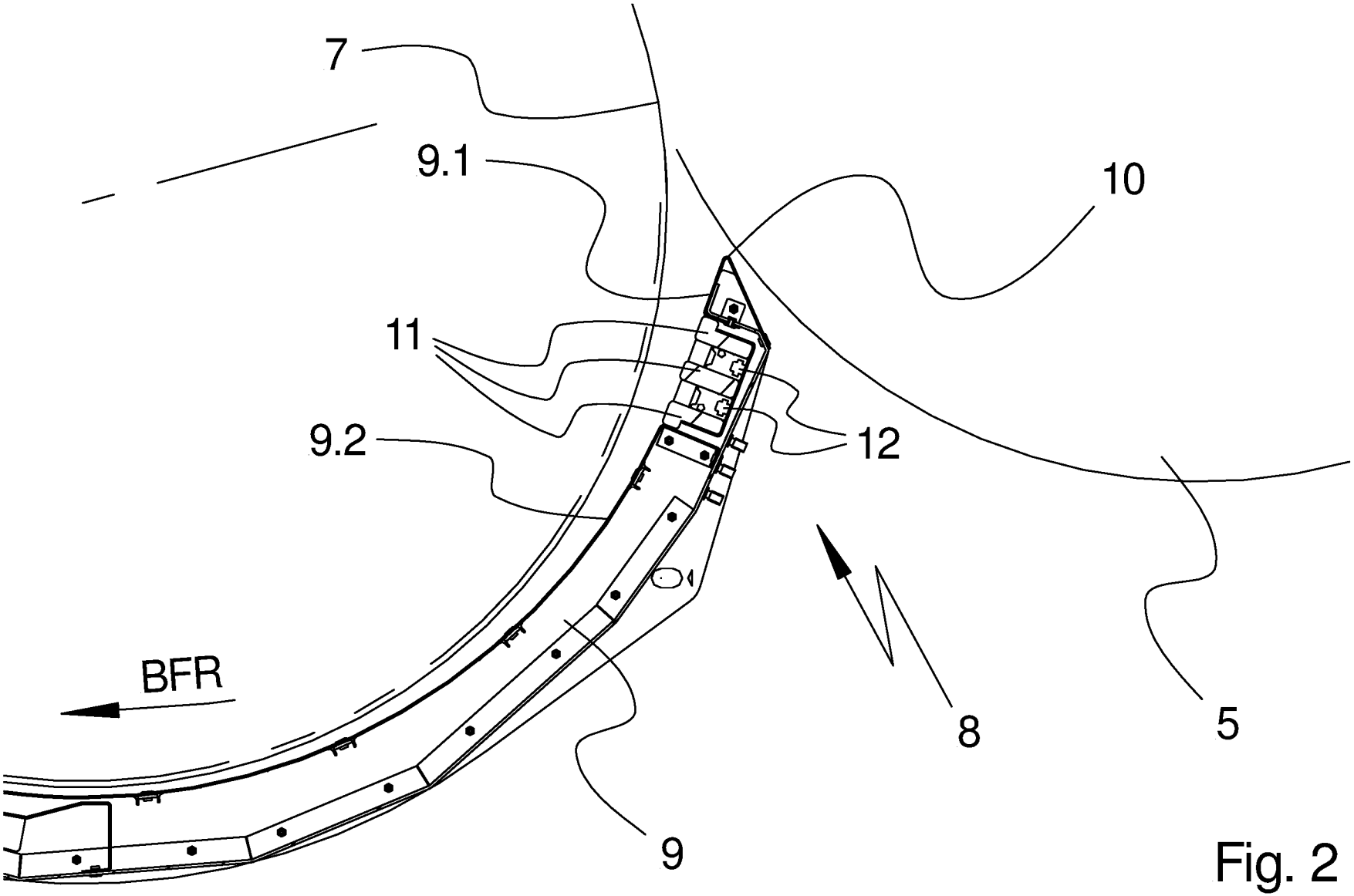
FIG. 2: shows an enlarged view of a sheet guide plate including comb fingers, comprising a deionization device.

FIG. 2 shows an enlarged view of a sheet guide element, configured as a sheet guide plate 9, comprising a deionization device 8. The deionization device 8 here comprises a cassette that is arranged in the sheet guide plate 9 and includes at least one discharge electrode 12. The cassette can preferably be recessed into the sheet guide plate 9 beneath a sheet conveyor system, in particular the sheet conveyor drum 7, and can also comprise multiple, preferably identical, discharge electrodes 12. The cassette here preferably comprises two discharge electrodes 12. The cassette is preferably arranged downstream from in particular metallic comb fingers 10, wherein an upstream guide surface section 9.1 can also be formed between the comb fingers 10 and the cassette. A downstream guide surface section 9.2 of the sheet guide plate 9 preferably directly adjoins the cassette of the deionization device 8 in the sheet conveyor direction BFR. In this arrangement, the upstream guide surface section 9.1 and the downstream guide surface section 9.2 are part of a shared guide surface of the sheet guide element 9. Particularly preferably, the upstream guide surface section 9.1 and/or the downstream guide surface section 9.2 is likewise configured to be metallic.

The sheet guide element, in particular the sheet guide plate 9, preferably surrounds the sheet conveyor system, in particular the sheet conveyor drum 7, for example a transfer drum without lateral surface, in a spiral shape. This means that the forward portion of the sheet guide element, in particular of the sheet guide plate 9, is held spaced further apart from an axis of rotation of the sheet conveyor system, in particular of the sheet conveyor drum 7, than the succeeding portion of the sheet guide element, in particular of the sheet guide plate 9. Thereafter, the sheet guide element, in particular the sheet guide plate 9, transitions preferably tangentially into a concentric radius with respect to the sheet conveyor system, in particular the sheet conveyor drum 7, so as to implement the optimal electrode spacing in the regions of the furthest distance of the guide plate spiral, excluding the comb fingers 10. This means that the guide surface of the sheet guide element 9 in the sheet conveyor direction BFR approaches the radius of the sheet conveyor drum 7, and thereafter leads around the same, concentrically with respect to the radius of the sheet conveyor drum 7.

Figure 3:
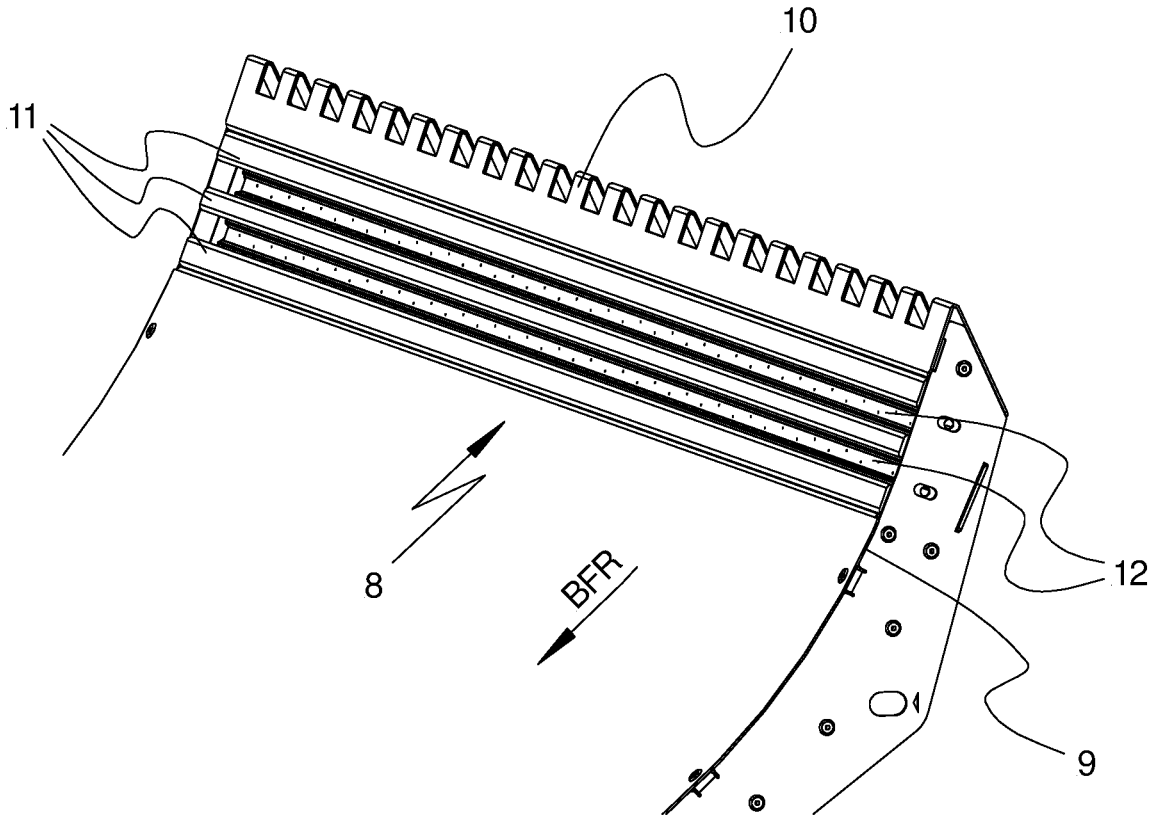
FIG. 3: shows a perspective view of the sheet guide plate comprising comb fingers and a deionization device.

FIG. 3 shows a perspective view of the sheet guide element, in particular of the sheet guide plate 9, comprising comb fingers 10 and a deionization device 8. The comb fingers 10 facing a sheet guide cylinder, in particular the impression cylinder 5, include in particular metallic finger elements which are spaced apart from one another and between which the movable gripper fingers of the gripper systems of the sheet guide cylinder, in particular of the impression cylinder 5, can be guided through. For example, the comb fingers 10 can be arranged at a distance of a few millimeters, for example between 1 and 10 mm, preferably between 2 mm and 3 mm, with respect to the lateral surface of the impression cylinder 5. The deionization device 8 is arranged downstream from the comb fingers 10 with respect to the sheet conveyor direction BFR. The deionization device 8 preferably includes both insulators 11 and one or more discharge electrodes 12 provided with electrical terminals. The discharge electrodes 12 are connected to an activatable generator, in particular a high voltage generator.

The insulators 11 of the deionization device 8 are in each case arranged transversely to the sheet conveyor direction BFR, preferably across the entire width of the sheet guide plate 9, and include surfaces arranged perpendicularly to the sheet conveyor path or to the sheet guide surface of the sheet guide plate 9. Each discharge electrode 12 here is in particular arranged between two insulators 11. A forward insulator 11, with respect to the sheet conveyor direction BFR, adjoins the, in particular metallic, comb fingers 10 with its perpendicular or tangential surface. Downstream from the deionization device 8, the sheet guide plate 9 preferably directly adjoins a perpendicular or tangential surface of a rear insulator 11, or a last insulator with respect to the sheet conveyor direction BF.

Figure 4:
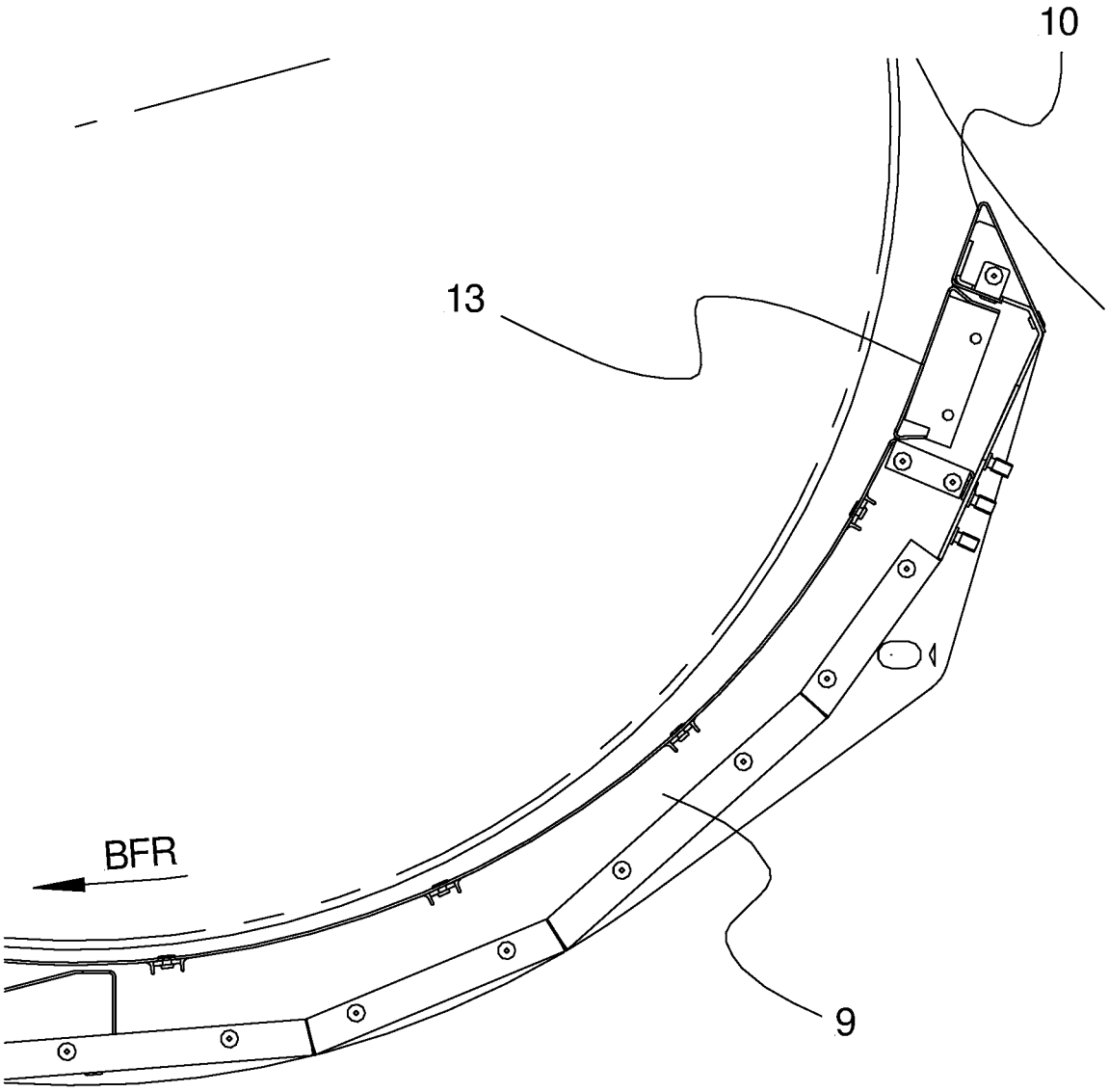
FIG. 4: shows an enlarged view of a sheet guide plate comprising a cover.

FIG. 4 shows an enlarged view of a sheet guide element, in particular of a sheet guide plate 9, comprising a cover. The entire deionization device 8, or the entire discharge cassette, can be exchangeably arranged in the sheet guide plate 9. As an alternative, the deionization device 8 can also be provided in the sheet guide element, for example rigidly or by means of displacement, whereby a cover, for example a cover part 13, can likewise close the opening. For example, it is provided that the discharge-generating elements are covered by means of a cover made of non-conducting material, in particular plastic material, which in particular has openings or cut-outs. The cut-outs are preferably arranged in such a way that the charge carriers of the discharge electrodes 12 are not influenced. An arrangement above the discharge cassette is preferably carried out in such a way that the ions can exit through preferably narrow slots and thereby reach the sheet underside.

Figure 5:
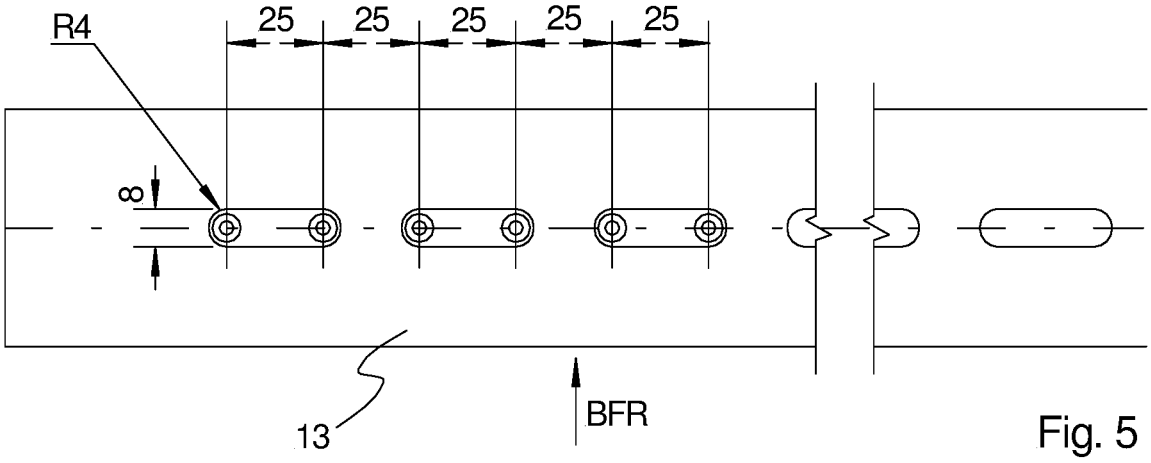
FIG. 5: shows a cover for the deionization device.

FIG. 5, by way of example, shows a cover for a deionization device 8 of a sheet-processing machine, as described above. The cover is arranged as a cover part 13 transversely to the sheet conveyor direction BFR above the deionization device 8, which is not shown, in particular a discharge electrode 12, and is in particular made entirely of a non-conducting material, in particular a plastic material. The cover part 13 includes a plurality of preferably uniformly arranged elongated holes, which are oriented transversely to the sheet conveyor direction BFR and here, for example, have a dimension of 25 mm transversely to the sheet conveyor direction BFR and 8 mm in the sheet conveyor direction BFR. In particular, a positive ion-emitting electrode tip and a negative-ion emitting electrode tip of the deionization device 8, in particular of the discharge electrode 12, are assigned to each elongated hole. The electrode tips indicated here act through the elongated holes, but in particular do not project into the sheet guide surface of the cover. The electrode tips are accordingly preferably arranged beneath the surface or are spaced apart from the sheet guide surface of the cover part 13. A discharge electrode 12 here comprises alternately arranged positive and negative ion-emitting electrode tips, which are in particular arranged equidistantly from one another and can operate with or without blower air support.

Figure 6:
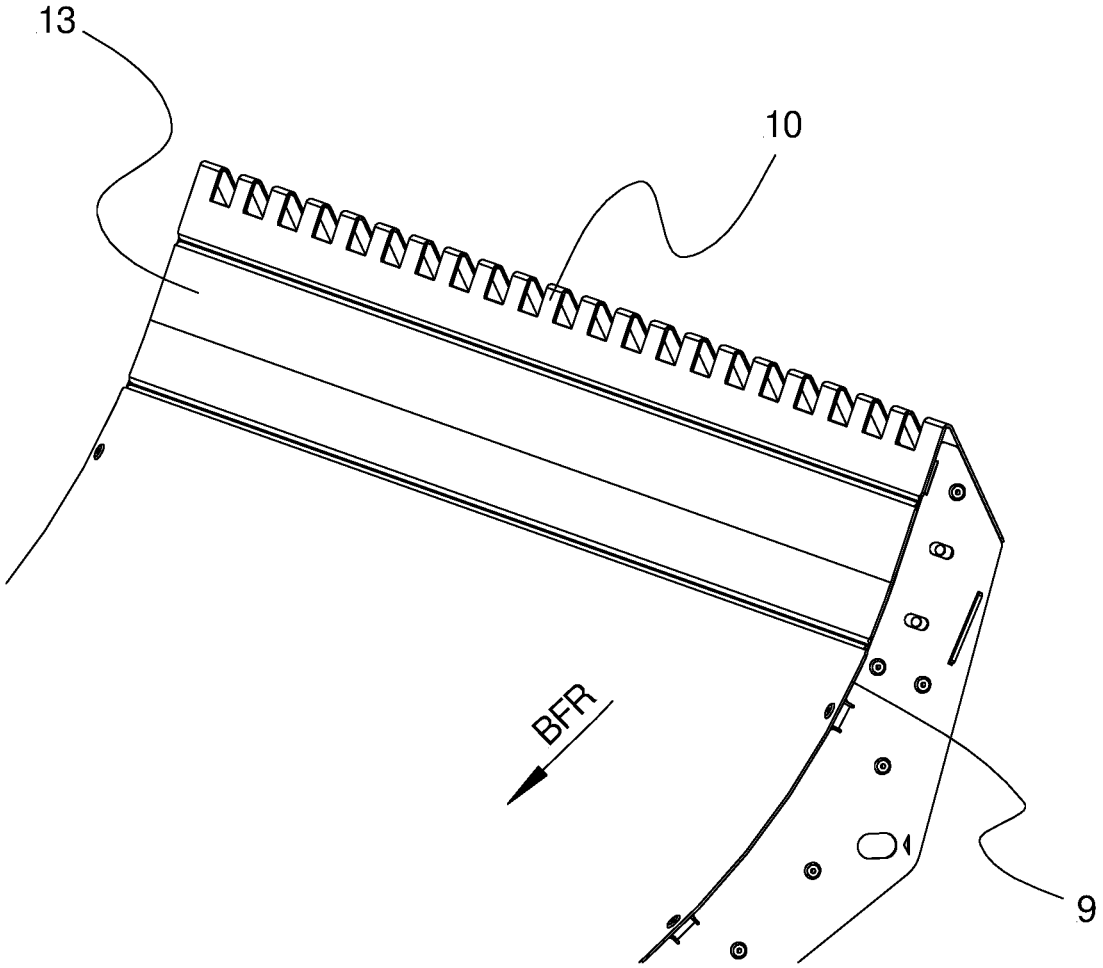
FIG. 6: shows a perspective view of a sheet guide plate comprising a cover.

FIG. 6 shows a perspective view of a sheet guide element, in particular a sheet guide plate 9, comprising a cover part 13. The cover part 13 is inserted into the sheet guide plate 9 in such a way as to create a preferably continuous sheet guide surface that is as devoid of disruptions as possible. Blower air openings can be provided in the sheet guide element, in particular in the sheet guide plate 9, and are not shown. Preferably, however, Venturi nozzles, which preferably blow to the side, are provided in the sheet guide surface of the sheet guide element, in particular of the sheet guide plate 9. These are particularly preferably arranged on the inlet and/or outlet sides, with a blowing direction component toward the edges of the sheet guide surface. This enables a resulting balanced floating height of the sheets on an air cushion, which is approximately in the gripper pad path, i.e., the pressure forces of the flow on the sheet only represent a counterpart to its surface load, which are, for example, only 1 Pa in the case of a 100 g/m$^2$ sheet, and, e.g., almost 0 Pa in the case of a 28 g/m$^2$ sheet. The forces acting through the Venturi nozzles on the sheet are thus dependent on the flow gap between the sheet guide surface and the sheet. If a deviation from the balanced floating height occurs, the force action thus always occurs in an aligning manner back to this balanced floating height. In the process, the increase in pressure forces below the floating height when the sheet approaches the sheet guide surface is comparatively higher than the increase in suction forces when the sheet moves away from the sheet guide surface beyond the floating height.

The mechanism of action involves disruptions that are caused by the extreme adhesion forces resulting from the printing pressure between the sheet, in particular the foil sheet, and the sheet guide cylinder, in particular the impression cylinder 5. When the sheet is transferred from the sheet guide cylinder, in particular the impression cylinder 5, to the sheet conveyor system, in particular to the sheet conveyor drum 7, the sheet is difficult to release because the pull-off forces only act tangentially. As the movement progresses further, the sheet, as a secant, intersects the sheet conveyor drum radius due to the pull-off forces in the sheet, and the "excess" of unwound sheet length created thereby allows the sheet adhering to the impression cylinder surface to further follow the impression cylinder 5. Even though the only truly releasing radial components of the previously only tangentially acting pull-off force are increased as a result, these are still low, and the sheet continues to follow the impression cylinder surface until the release loop of the sheet is peeled off by the pneumatically acting forces of the comb plate, in particular without making mechanical contact. The air cushion generated by the Venturi nozzles cannot contribute to the sheet being pulled off the impression cylinder 5, since the suction potential of the air cushion does not act on the regular sheet path or the balanced floating height.

Furthermore, the sheet, due to the electrostatic charge, is attracted by the sheet guide element, in particular the sheet guide plate 9, when pulled off the sheet guide cylinder, in particular the impression cylinder 5, in this way and would make contact therewith. The present air cushion of the sheet guide plate 9, serving as a distributed load against the non-uniformly distributed field forces of the electrostatic charge, would not be able to create balance, and consequently would not create a floating state. Regions of intensive contact with the sheet guide plate 9 would arise. Any intensive contact with the sheet guide plate 9, however, results in visible scratches on the surface of the sheets, in particular of foil sheets, or in smearing, especially on paper sheets. Due to the above-described specific embodiment of the sheet guide element, in particular of a sheet guide plate 9, however, an effective, the distance preserving measure is devised for the scratch-free or non-smearing guidance of sheets, in particular of foil sheets, on the sheet guide surface under a sheet conveyor system, in particular the sheet conveyor drum 7, after the sheet has been released from the sheet guide cylinder, in particular the impression cylinder 5. As a result of the devised solution, contact of the sheet, in particular the foil sheet, with the sheet guide element, in particular the sheet guide plate 9, specifically with the comb and the subsequent guide surface components, and thereby scratches and smearing, are prevented.

Furthermore, a controller or also automatic sensor-controlled closed-loop control of the one, multiple or all discharge electrodes 12 of one, multiple or even all deionization devices 8 of the machine 1 can be provided in the machine 1. For example, individual discharge electrodes 12, or multiple discharge electrodes 12 of a deionization device 8, or multiple or all deionization devices 8 of the machine can be connected to a generator, in particular a high voltage generator. The discharge action can be set by way of an activation of the generator. For example, the intensity of the deionization device 8 can be controlled by closed-loop or open-loop control by way of measuring equipment in such a way that it is possible to control the discharge in a manner that is matched to the static electricity at the sheet, in particular the foil sheet. Furthermore, in particular in the case of exchangeable discharge cassettes, an arrangement thereof in another location of the machine 1 can be provided. In particular, such a cassette or deionization device 8 can be used in the turning zone. The discharge cassettes can thus be configured to be exchangeable among one another in the machine 1 or have a modular configuration.

Figure 7:
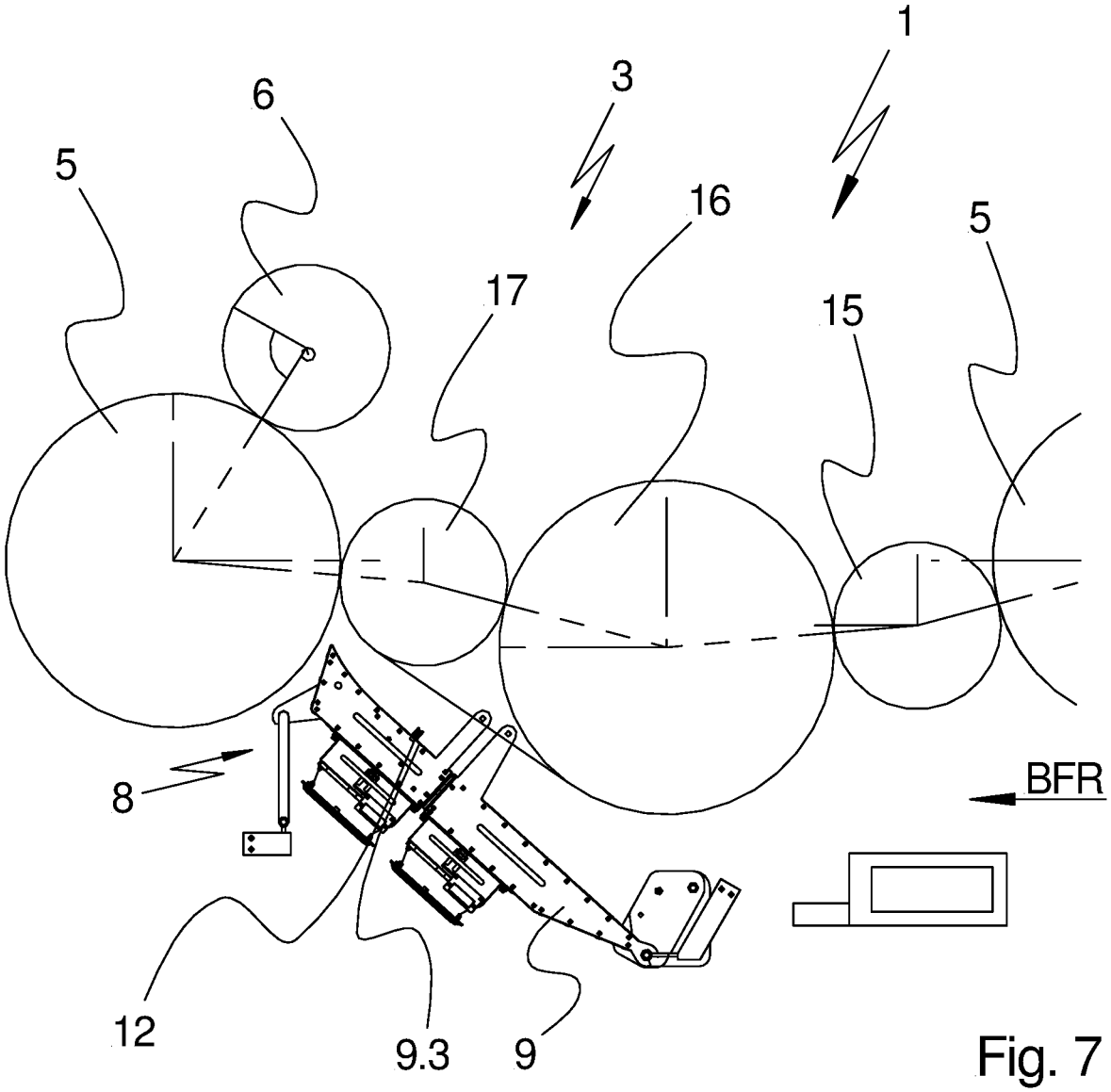
FIG. 7: shows a section of a sheet-processing machine comprising a turning device that includes a sheet guide element comprising a deionization device.

FIG. 7 shows a section of a sheet-processing machine 1 equipped, by way of example, for foil sheet processing, in particular as described above, comprising a turning device 3 and a sheet guide element. The turning device 3 is implemented as a triple-drum turning device here and includes a transfer drum 15, a storage drum 16 and a turning drum 17. The turning device 3 is preferably arranged between the printing units 2 of the machine 1, wherein a sheet guide cylinder, in particular an impression cylinder 5, of a printing unit 2 is arranged immediately upstream from the transfer drum 15, or a sheet guide cylinder, in particular an impression cylinder 5, of the succeeding printing unit 2 is arranged downstream from the turning drum 17. The impression cylinders 5, in turn, are functionally connected to a blanket cylinder 6, which in turn is functionally connected to a plate cylinder, which is not shown, in the printing units 2, as described above. The machine 1 can be switched between the recto printing and recto and verso printing operating modes, wherein sheets are conveyed without being turned in the recto printing operating mode in that the leading sheet edge is transferred between the drums.

The transfer drum 15 and the turning drum 17 of the turning device 3 have a single-sized configuration, for example, and the storage drum 16 has a double-sized configuration, for example. For conveying the sheets, the transfer drum 15 comprises a gripper system, which is not shown and arranged in a gripper channel, for clamping the sheets at the leading edge. The sheets are transferred in the gripper closure to a gripper system of the storage drum 16, which is likewise not shown and arranged in a gripper channel. From the storage drum 16, the sheets, being clamped at the leading edge, are fed to the turning drum 17 during the rotation of the storage drum 16. For conveying the sheets, the turning drum 17 comprises a gripper system, which is likewise not shown, in particular grippers and/or suckers that are pivotably mounted in the turning drum 17. As an alternative, the turning drum 17 can also include a pincer gripper system for receiving or conveying the sheets. Other cylinder arrangements or other cylinder sizes can also be used. For example, the transfer drum 15 can also have a double-sized configuration.

In the recto printing operating mode, the sheets are received by the gripper system of the turning drum 17 in a transfer center line at the leading edge by a gripper system of the storage drum 16. When a sheet is turned during recto and verso printing, this sheet is guided past the transfer center line by the storage drum 16 and gripped at the trailing edge by the gripper system of the turning drum 17. This gripped sheet is subsequently turned, as the rotation of the turning drum 17 progresses, according to the principle of trailing edge turning, so that its old trailing edge becomes the new leading edge starting with its motion reversal, and the old leading edge located on the storage drum 16 becomes the new trailing edge. The turning device 3 is assigned a sheet guide element for supporting the sheet travel, in particular in the recto and verso printing operating mode. For example, a sheet guide element, configured in particular as a sheet guide plate 9, for supporting the sheet guidance can be arranged beneath the storage drum 16 and the turning drum 17. The sheet guide element, in particular the sheet guide plate 9, can also be configured, for example, as a sheet guide element, in particular a sheet guide plate 9, that can be displaced as a function of the operating mode. Such a displaceable sheet guide element, in particular sheet guide plate 9, can be supplied to the sheet conveyor path, at least in the recto and verso printing operating mode.

The storage drum 16, which is not shown in detail, can comprise format-settable shell segments, for example, which during format setting mesh with one another in a comb-like manner and form the sheet-supporting lateral surface. The two diametrically opposed gripper systems of the double-sized storage drum 16 for the leading sheet edges are arranged at preferably stationary forward shell segments. At the rear shell segments, which are adjustable with respect to the forward shell segments, fixation systems, in particular suction systems, for example, twisting suckers and/or tautening suckers, can be provided for receiving and guiding the trailing sheet edges. By way of twisting suckers, the sheets, while the sheets are conveyed from the transfer drum 15 to the turning drum 17, can be tautened in particular longitudinally and/or transversely, lying on the storage drum 16. Even when the turned sheet is pulled off the storage drum 16 by the turning drum 17, tautening of the sheet can preferably be carried out by the fixation systems, in particular the suction systems, such as the twisting suckers or also tautening suckers, in the tines of the rear adjustable shell segments of the storage drum 16.

To support the sheet guidance during recto and verso printing, the sheet guide element arranged below the storage drum 16 and the turning drum 17 can be configured to be settable thereagainst, so that its sheet guide surface is at least approximately aligned parallel to the sheet conveyor path. The sheet conveyor path at least approximately corresponds to a surface that is placed tangentially both against the lateral surface of the storage drum 16 and the turning drum 17. The sheet guide surface of the sheet guide element, in particular of the sheet guide plate 9, can also be slightly approaching the turning drum 17. The sheet guide element, in particular the sheet guide plate 9, has a planar guide surface 9.3 at least in some areas, which particularly preferably is located beneath the turning drum 17, in particular beneath the axis of rotation of the turning drum 17. A deionization device 8 is assigned to the sheet guide element, in particular to the planar guide surface 9.3 of the sheet guide plate 9. The deionization device 8 comprises at least one discharge electrode 12 for discharging a sheet. The deionization device 8, in particular the at least one discharge electrode 12, causes a discharged sheet to be freed from electrostatic force actions, so that it can be smoothed so as to be able to pass the succeeding press nip or the printing zone without ripples and without creases.

Figure 8A:
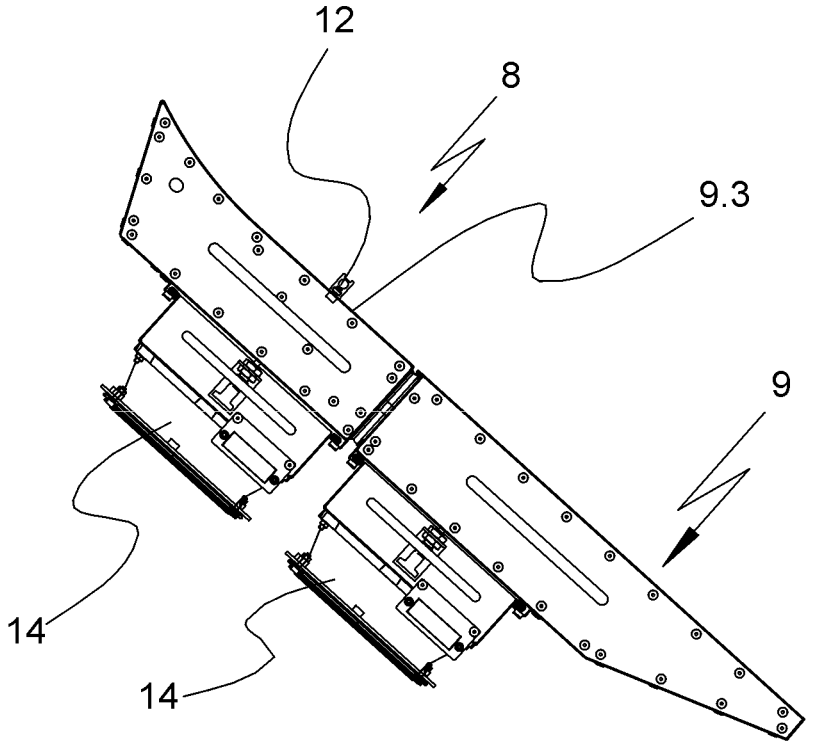
FIG. 8*a*: shows an embodiment of a sheet guide plate of the turning device including an attached discharge electrode.

FIG. 8*a* shows an embodiment of a sheet guide plate 9 of the turning device 3 including an attached discharge electrode 12. The discharge electrode 12 is preferably arranged transversely to the sheet conveyor direction BFR across the machine width and is provided with appropriate electrical terminals. The discharge electrode 12 is preferably assigned to the planar guide surface 9.3 of the sheet guide plate 9, wherein a region approaching the turning drum 17 can adjoin the planar guide surface 9.3 in the sheet conveyor direction BFR. Preferably, at least one fan 14, which can in particular be activated for generating blower and/or suction air, can be assigned to the sheet guide element, in particular the sheet guide plate 9. Corresponding openings, for example Venturi nozzles, facing the sheet conveyor path, are assigned to the sheet guide element, in particular to the sheet guide plate 9. In particular, suction and/or blower air can be generated by the fan 14 at least in the region of the planar guide surface 9.3 of the sheet guide plate 9. The fan 14 can be provided in the region of the discharge electrode 12 on the side of the sheet guide plate 9 that faces away. The sheet guide element, in particular the sheet guide plate 9, can likewise have a single-piece configuration, or can be composed of multiple segments, wherein a fan 14 can also be assigned to an upstream segment that is substantially arranged beneath the storage drum 16.

Figure 8B:
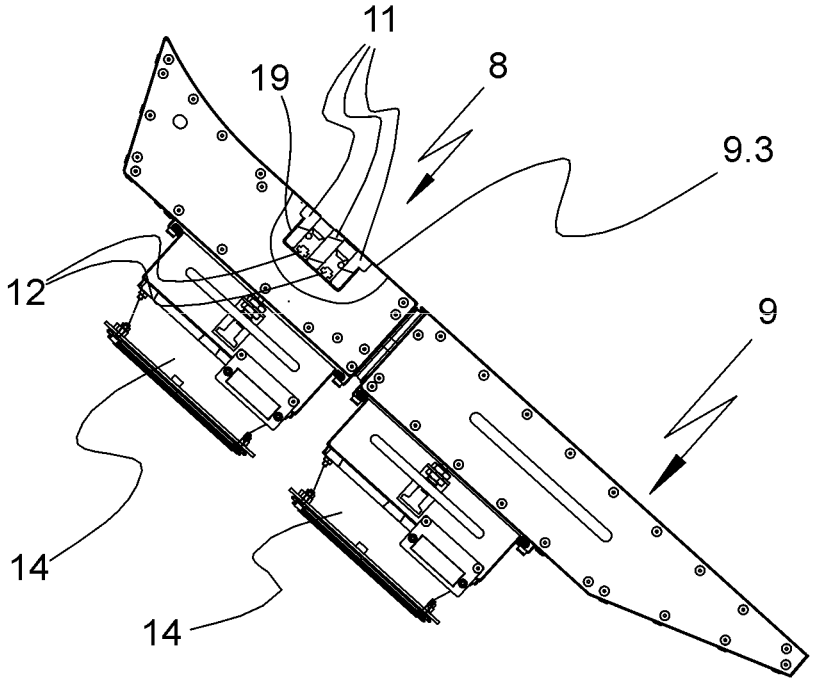
FIG. 8*b*: shows an embodiment of a sheet guide plate of the turning device including integrated discharge electrodes.

FIG. 8*b* shows an embodiment of a sheet guide plate 9 of the turning device 3 including an integrated deionization device 8. The deionization device 8 can comprise a cassette that is recessed in the sheet guide plate 9 and in particular configured to be exchangeable, as seen at 19 in FIG. 8*b*. The deionization device 8 preferably comprises multiple discharge electrodes 12, which are arranged so as to be spaced apart from one another, transversely to the sheet conveyor direction BFR, preferably across the machine width. Respective insulators 11, whose surfaces terminate tangentially at the sheet guide plate 9, in particular as described above, are positioned between the discharge electrodes 12, which are preferably recessed here. At least one fan 14 can preferably be assigned to the sheet guide element, in particular the sheet guide plate 9, for generating blower and/or suction air, in particular at least in the region of the planar guide surface 9.3, as described above. In the at least one recessed discharge electrode 12, furthermore a cover for creating a substantially closed sheet guiding surface can be provided in the region of the discharge electrode 12. A cover part, which is not shown and has openings adapted to one or more discharge electrodes 12, can be assigned to the sheet guide plate 9, in particular immediately above the discharge electrode 12 or discharge electrodes 12, in particular as described above. The cover part, which is not shown, can be configured or arranged as described above.

One of the described sheet guide elements, in particular such a sheet guide plate 9, is assigned to the transfer region between the storage drum 16 and the turning drum 17 in the machine 1. A sheet guide plate 9 in particular downwardly delimits the long side of the turning zone and is spaced apart from the cylinder tangent between the storage drum 16 and the turning drum 17 in such a way that the distance with respect to the sheet corresponds to the optimal electrode spacing. Furthermore, a fixation of the sheet lying on the storage drum 16 can be provided by the fixation systems, in particular the suction systems, for example twisting suckers and/or tautening suckers, of the storage drum 16, so that the sheet is additionally tightened or tautened in the vicinity of the cylinder tangent between the storage drum 16 and the turning drum 17. In this way, it can in particular be achieved that not only the optimal electrode spacing is preserved across the entire sheet length, but also that the sheet can be influenced where, on the upper side and underside, it remains free of ion-binding contact with machine parts with mass. This advantageously causes the ions to be able to transition with little impediment into the activated deionizing ambient air.

Figure 9:
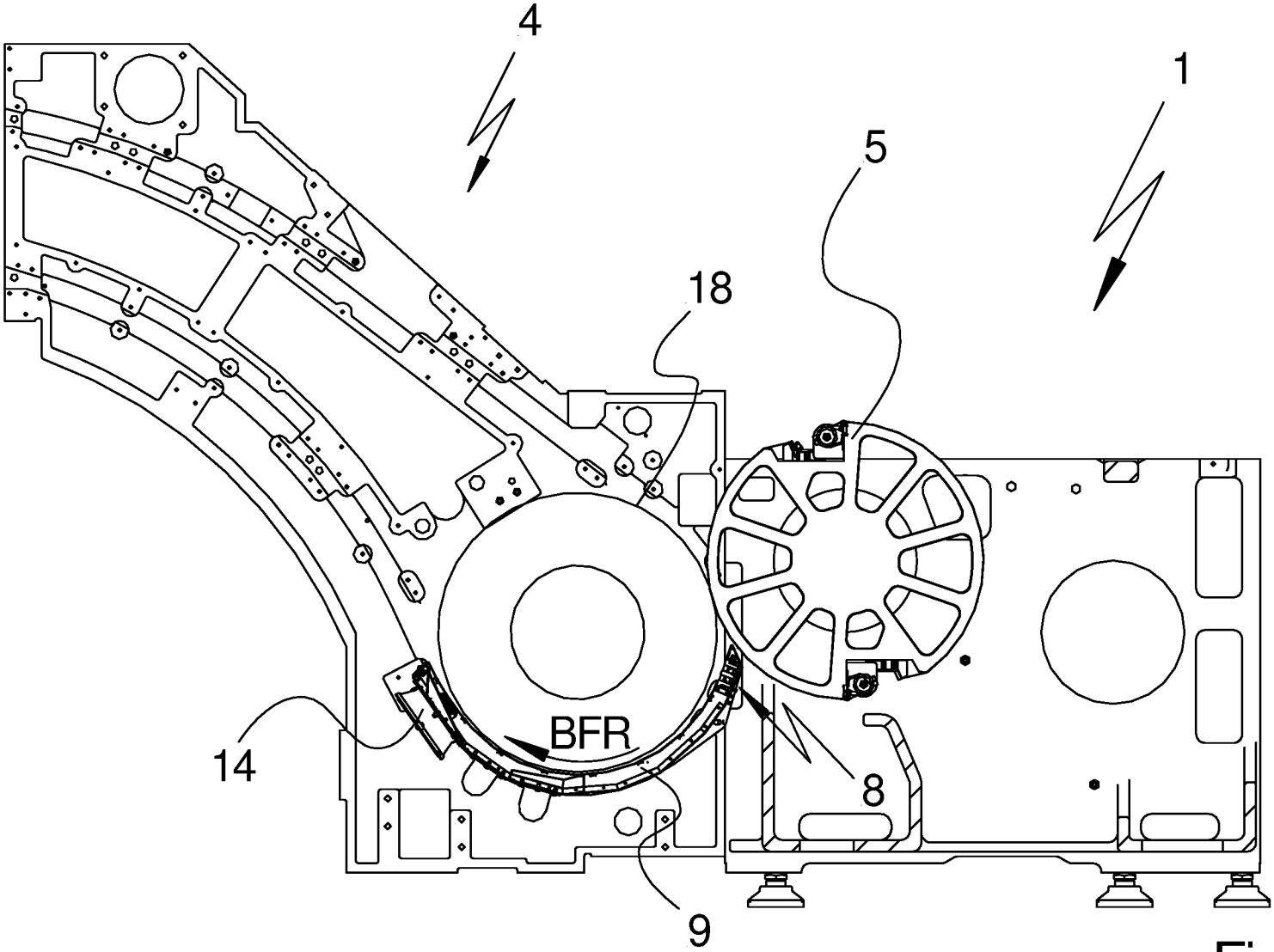
FIG. 9: shows a section of a sheet-processing machine including a last sheet guide cylinder and a delivery.

FIG. 9, by way of example, shows a section of a sheet-processing machine 1, in particular of a foil sheet-processing machine 1, for example as described above, comprising a delivery 4. The machine 1 is accordingly preferably configured to process foil sheets and is in particular implemented as a foil sheet processing machine, as described above. The delivery 4 comprises a sheet-conveying sheet conveyor system, which is not shown in greater detail and which receives the sheets processed in the machine 1, for example printed and/or coated, from the last sheet guide cylinder and conveys or transports them to a delivery pile, which is not shown in greater detail. This sheet conveyor system is preferably configured as a chain conveyor system, comprising two delivery chains which are each guided laterally at the stand of the delivery 4 and between which gripper carriages are arranged equidistantly with respect to and parallel to one another. The gripper carriages comprise sheet fixing systems, by way of which the sheets to be conveyed are gripped at the leading edge. The gripper carriages can receive the leading sheet edges accordingly from the last sheet guide cylinder of the machine 1 in the gripper closure. The gripper carriages, which are driven and guided in a continuously revolving manner, in particular comprise gripper fingers, which can be moved against stationary gripper pads, for receiving the sheets, preferably at the leading edge, from the last sheet guide cylinder of the machine 1.

In the delivery 4, the gripper carriages are guided by the delivery chains on a gripper carriage track in the sheet conveyor direction BFR to beyond the delivery pile, where the gripper carriages release the substrates for stacking. For releasing the sheets, the clamped leading sheet edges are released in that the gripper fingers are lifted off the gripper pads fixedly arranged at the gripper carriage. The gripper fingers can be moved by way of radial cams and control levers via a gripper shaft at which the gripper fingers are fixedly arranged. With respect to the sheet conveyor direction BFR, a sheet brake is preferably arranged upstream from the delivery pile, which decelerates the sheets to be deposited from the machine speed to the stacking speed after they have been released. After having been decelerated by the sheet brake, the sheets are, for example, aligned at leading, trailing and/or side edge stops and neatly deposited on the delivery pile. The delivery pile is lowered by a pile lifting drive during the sheet stacking process in such a way that the delivery pile surface forms an at least approximately constant stacking level for the arriving sheets.

On the sheet conveyor path to the delivery pile, at least one mechanical sheet guide element is arranged in the delivery 4 beneath the sheet conveyor path, which guides the sheets downstream from the last sheet guide cylinder on the path to the delivery pile. The sheets, which, for example, have been fully printed on both sides in the machine 1, are conveyed by the continuously revolving gripper carriage of the chain conveyor system from the last sheet guide cylinder to the delivery pile. The gripper pads revolving together with the gripper carriages thus describe a gripper pad path, which substantially corresponds to the sheet conveyor path or delimits it on one side, and thereby defines it. The last sheet guide cylinder of the machine 1 is in particular an impression cylinder 5 of the last printing, coating, drying, inspection or finishing unit, which in particular has an at least approximately closed lateral surface. The impression cylinder 5 preferably has a double-sized configuration and comprises two gripper systems that are arranged diametrically opposed in gripper channels, as described above. These gripper systems in particular likewise comprise movable gripper fingers that correspond to gripper pads delimiting or defining the sheet conveyor path. The leading sheet edges are received from these gripper systems by the gripper carriages of the chain conveyor system in the gripper carriage. For receiving the leading sheet edge, the gripper fingers of the impression cylinder 5 are arranged in a staggered layout in relation to the gripper fingers of the gripper carriages. This receiving of the leading sheet edge takes place in a transfer center line in which the leading sheet edge is briefly fixed by both grippers.

The chain conveyor system in the delivery 4 comprises a sprocket wheel shaft, which is arranged adjoining the last sheet guide cylinder, in particular the impression cylinder 5, and includes two sprocket wheels 18 that are arranged coaxially with respect to and spaced apart from one another and that are fixedly connected to the sprocket wheel shaft. The delivery chains run over the sprocket wheels 18 and can be driven by these in a revolving manner. The sprocket wheel shaft can, for example, be driven via the continuous drive wheel train, together with sheet conveyor systems and sheet guide cylinders, in the units or printing units 2 of the machine 1. The sheet guide element, which is preferably configured as a sheet guide plate 9 that preferably extends across the machine width and is arranged between the side walls, is arranged beneath the sprocket wheel shaft between the sprocket wheels 18. This sheet guide plate 9 preferably has an at least approximately closed surface for guiding the sheets in a sliding and/or floating manner. The sheet guide plate 9 can be provided with an ink repellent coating. Furthermore, nozzle openings, in particular Venturi nozzles, for pneumatically guiding the sheets can be assigned to the sheet guide plate 9.

For example, one or more blower modules or fans 14, by way of which blower air nozzles of the sheet guide plate 9 can be supplied with blower air and/or suction air, can be arranged beneath the sheet guide plate 9, which can also be formed of assembled guide segments, so that a supporting air cushion can be formed between the sheet guide plate 9 and the sheets conveyed or transported by the gripper carriages, in particular for recto and verso printing. A preferably deactivatable smoothing device can be assigned to the sheet guide element, in particular the sheet guide plate 9. Such a smoothing device can be deactivated or is not used when sheets containing fresh ink, for example in recto and verso printing, or also foil sheets are transported or guided. The sheet guide elements, in particular the sheet guide plates 9 of the machine 1 are in particular configured to be identical. To be able to avoid that the sheets stick together on the delivery pile, dryers and/or powdering devices, which are not shown in greater detail, can be provided in the delivery 4. It is also possible to integrate a cooling circuit in the sheet guide element to be able to control by open-loop or closed-loop control heating of the sheet guide element.

The sprocket wheel shaft in the delivery 4 in particular does not include a lateral surface for supporting the sheets. In a refinement, the sprocket wheel shaft can contain two or more support disks or suction disks, or also individual suckers, such as corner suckers, in addition to the sprocket wheels 18 for the revolving delivery chains. For example, the support disks with or without corner suckers or the suction disks can be configured to be axially displaceable so as to be adjustable to the respective sheet side edges. Such disks can also be axially adjusted automatically and/or independently of one another. Such disks in particular include supporting surfaces around the circumference, which have a minimal axial extension. As a result of this extension of the support disks present in the axial direction, a respective sheet can be fixed on the lateral surface of the sheet guide cylinder, in particular of the impression cylinder 5, when receiving the sheets. In this way, a drop of the sheet is avoided as long as the sheet is situated between the disks and the last sheet guide cylinder, in particular the impression cylinder 5. The sheets are preferably pressed against the lateral surface of the impression cylinder 5 by support elements arranged on brackets in small press nips. The support elements can have elastic surfaces. Such disks preferably likewise have a double-sized configuration and can preferably include recesses for the revolving gripper carriages of the chain conveyor system.

Figure 10:
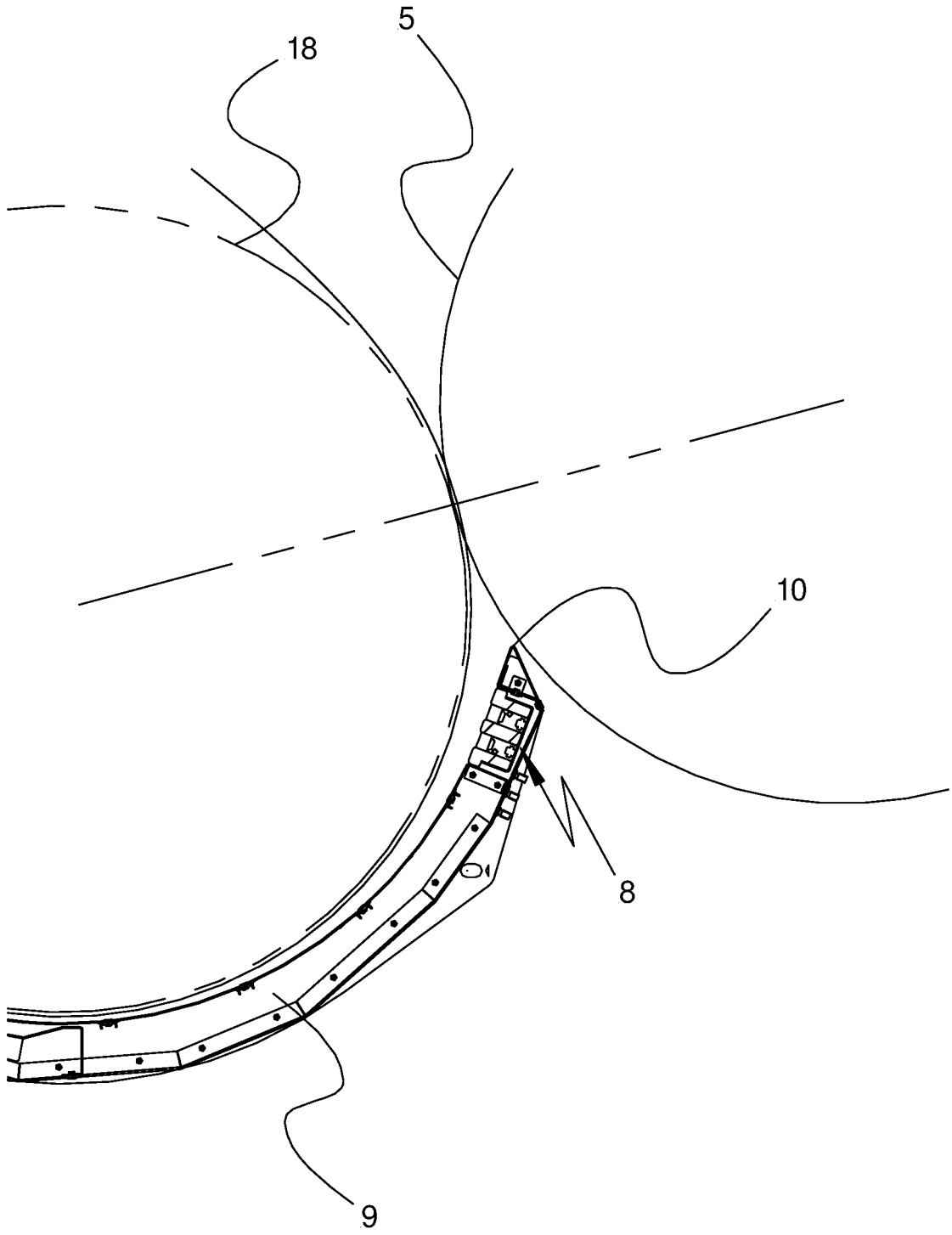
FIG. 10: shows a sheet guide cylinder including a downstream sprocket wheel shaft and a sheet guide plate arranged beneath the sprocket wheel shaft.

FIG. 10 shows a last sheet guide cylinder, in particular an impression cylinder 5, of the machine 1, comprising a downstream sprocket wheel 18 of the sprocket wheel shaft, and a sheet guide element arranged beneath the sprocket wheel shaft, in particular an above-described sheet guide plate 9. A connecting line is shown between the axis of rotation of the sprocket wheel 18 and the axis of rotation of the impression cylinder 5, on which the transfer center line in the transfer region is located. The sheet guide plate 9, which in the region facing the impression cylinder 5 comprises in particular metallic comb fingers 10, is arranged beneath the sprocket wheel shaft, in particular as was already described with respect to the printing unit 2. In the region of the sheet guide cylinder, in particular of the impression cylinder 5, the sheet guide plate 9 is preferably spaced further apart from the axis of rotation of the sprocket wheel shaft or of the sprocket wheel 18 than the regions of the sheet guide plate 9 that adjoin in the sheet conveyor direction BFR. For example, the comb fingers 10 can be arranged at a distance of a few millimeters, for example between 1 and 10 mm, preferably between 2 mm and 3 mm, with respect to the lateral surface of the impression cylinder 5. In particular, the sheet guide plate 9 in the delivery 4 is implemented to be at least approximately identical to the sheet guide plates 9 in the printing units 2 or units of the machine 1. This ensures preferably identical favorable sheet guidance conditions in the entire machine 1.

Figure 11:
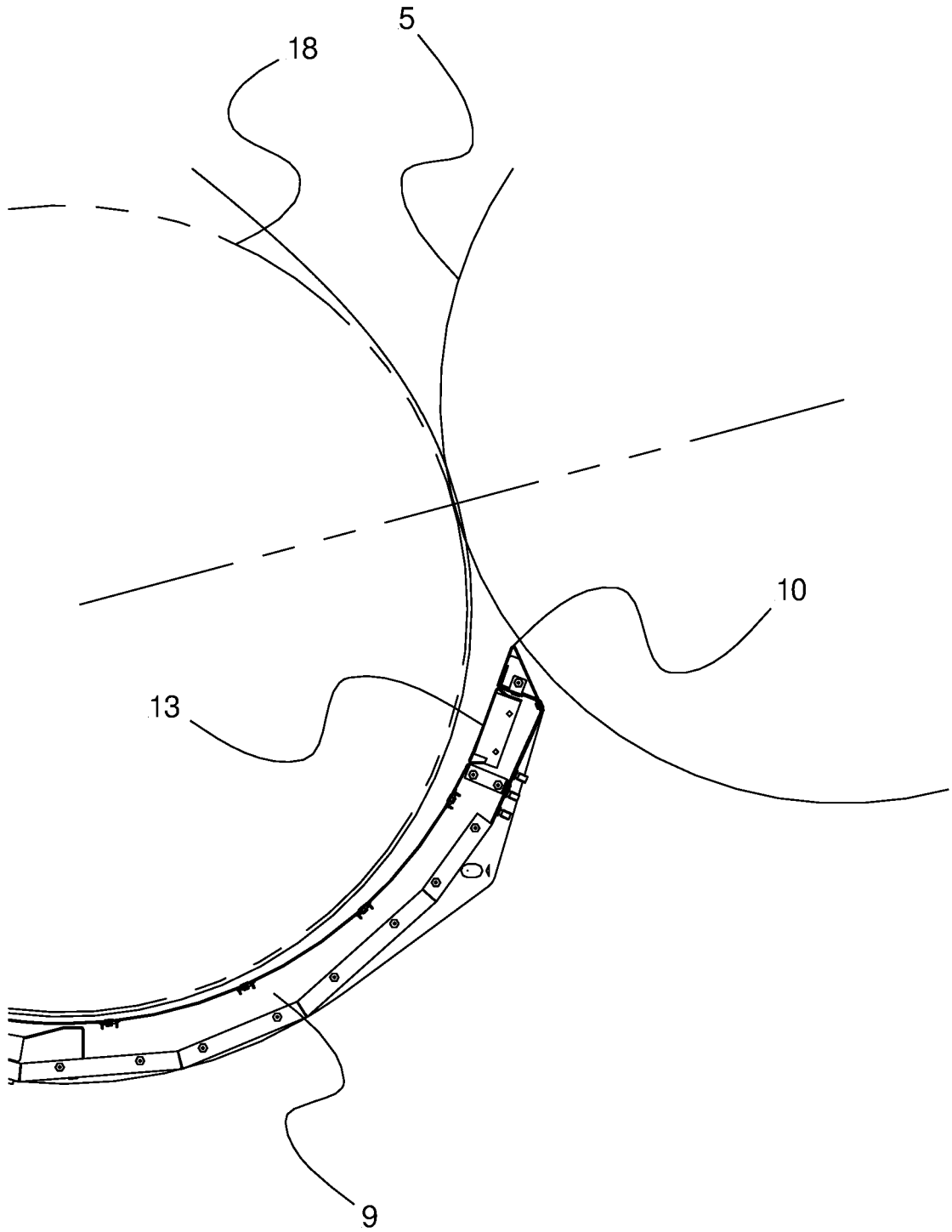
FIG. 11: shows a sheet guide cylinder including a downstream sprocket wheel shaft and a sheet guide plate that is arranged beneath the sprocket wheel shaft and comprises a cover.

FIG. 11 shows a sheet guide cylinder, in particular an impression cylinder 5, for example as described above, comprising a downstream sprocket wheel shaft and a sheet guide element, in particular a sheet guide plate 9, that is arranged beneath the sprocket wheel shaft and comprises a cover, as described above. The sheet guide plate 9, shown in a side view, comprises a cover, in particular an above-described cover part 13 that contains a non-conducting or non-metallic material or is made of a non-conducting or non-metallic material. The deionization device 8 can, for example, be removable from the sheet guide element, in particular the sheet guide plate 9. The deionization device 8 can, for example, be removed beneath or between sprocket wheels 18 of the sprocket wheel shaft. The deionization device 8 can, for example, be removed laterally and/or by displacing at least a portion of the sheet guide plate 9. The cover, in particular the cover part 13, closes the opening required by the deionization device 8. The cover is preferably dimensioned or attachable in such a way that a steady or approximately full sheet guide surface of the sheet guide plate 9 is obtained. The cover part 13 can be configured or arranged as described above.

Regarding the mechanism of action: The sheets are received from a sheet guide cylinder, in particular a storage drum 16 or an impression cylinder 5 by a sheet conveyor system in the turning device 3 and/or in a unit or printing unit 2, in particular a turning drum 17 or sheet conveyor drum 7 or a gripper carriage in the delivery 4, and are guided past a deionization device 8 along the sheet guide element, in particular the sheet guide plate 9, on the sheet conveyor path. In a refinement, a device can be provided in the region of a transfer drum or of a sprocket wheel shaft, which additionally guides the sheet, held only at the edges, in the vicinity of the gripper pad path in a defined manner so that the optimal electrode spacing is preserved across the full sheet length, and the sheet does not make contact with the sheet guide plate 9 prematurely and drops below said optimal electrode spacing.

The sheets, in particular the foil sheets, are released from the lateral surface of the sheet guide cylinder, in particular of the impression cylinder 5, by the sheet guide element, in particular the sheet guide plate 9, preferably in a spiral shape. In particular the comb fingers 10 of the release loop of the sheet give way at a suitable distance when the sheet is pulled off the lateral surface. Allowing a minimal pull-off loop advantageously increases the releasing radial component of the pull-off forces. By arranging the Venturi nozzles along the guide contour of the sheet guide element in connection with the associated balanced floating height of the sheets beneath the gripper pad path, the suction forces of the air cushion can act on the sheet present on the regular sheet path. In this way, the sheet is held on the outside of the radius of the gripper pad path, and the release loop is kept small.

Due to the at least one discharge electrode 12 that is in particular recessed at the guide plate start, a charge equalization is brought about at the sheet until sufficient charge neutrality is reached, so that the sheet is not subsequently attracted by the sheet guide element, in particular the sheet guide plate 9, as an electrical conductor. Due to the deionization device 8, in particular positive and negative ions are provided to be able to equalize the alternating charge states on the sheet surface. A deionization device 8 is used in particular in each printing unit 2 or unit of the machine 1 since the sheet, in particular the foil sheet, undergoes extreme re-charging during each printing process.

The sheets are in particular optimally discharged by the deionization device 8 of the or each printing unit 2, preferably each unit, of the turning device 3 and/or of the delivery 4. As a result of the discharge, it is possible to feed the sheet in a constantly floating state to the next conveyor system, for example an impression cylinder 5 or a gripper carriage, without the sheet becoming scratched due to contact with the sheet guide element, in particular a sheet guide plate 9. Due to the one or more discharge electrodes 12 of a respective deionization device 8, in particular active discharging is ensured, both with positive and with negative ions. Provided generators preferably operate in a range of 3 to 6 kV, optimally with a high voltage of at least approximately 4.5 kV. The high voltage can also be set as a function of the ascertained electrostatic charge. A respective sheet is discharged by the deionization devices 8, so that the deionized sheets are free of electrostatic forces and rest in a smoothed manner on the sheet guide plate 9 or the air cushion generated by the sheet guide plate 9. The sheets remain deformation-free and smear-free across the entire machine 1.

While a preferred embodiment of a sheet-processing machine comprising a turning device, a method for conveying sheets, and the use of sheet guide elements containing deionization devices, all in accordance with the present invention, has been set forth fully and completely hereinabove, it will be apparent to one of skill in the art that various changes could be made thereto, without departing from the true spirit and scope of the present invention, which is accordingly to be limited only by the appended claims.

The invention claimed is:

1. A sheet-processing machine (1) comprising a turning device (3), sheets being receivable by a turning drum (17) from a storage drum (16) in the turning device (3) and conveyable in the sheet conveyor direction (BFR) on a sheet conveyor path, and a sheet guide element (9) being provided beneath and/or along the sheet conveyor path, characterized in that a deionization device (8) is assigned to the sheet guide element (9), the sheet guide element (9) being assigned, as a sheet guide plate (9), to a transfer region between a storage drum (16) and a turning drum (17), and the deionization device (8) comprising at least two discharge electrodes (12) that are spaced apart from one another and/or are arranged transversely to the sheet conveyor direction (BFR).

2. The sheet-processing machine according to claim 1, wherein the sheet guide element (9) has a planar guide surface (9.3) at least in some areas, and the deionization device (8) is arranged in the region of the planar guide surface (9.3).

3. The sheet-processing machine according to claim 1, wherein the deionization device (8) comprises at least one discharge electrode (12) that is placed onto one of a guide surface (9.3) of the sheet guide element (9) and a cassette, which is recessed in a sheet guide plate (9) and includes at least one discharge electrode (12).

4. The sheet-processing machine according to claim 3 one of wherein the guide surface is planar and the cassette is exchangeable.

5. The sheet-processing machine according to claim 1, wherein a cover (13), for creating a substantially closed guide surface, (9.3) is provided in the region of the deionization device (8).

6. The sheet-processing machine according to claim 5 wherein the cover is made of non-conducting material.

7. A method for conveying sheets in a sheet-processing machine (1), sheets being received by a sheet conveyor system (7, 17, 18) from a sheet guide cylinder (5, 16) and conveyed in the sheet conveyor direction (BFR) on a sheet conveyor path along a sheet guide element (9), the sheets being guided by the sheet guide element (9), the sheets being guided past a deionization device (8) assigned to the sheet guide element (9), and positive and negative ions being provided by a plurality of discharge electrodes (12) of the deionization device (8) to be able to equalize the alternating charge states on the sheet surface, a discharge electrode (12) comprising electrode tips that are alternatingly arranged and emit positive and negative ions.

8. The method according to claim 7, wherein the sheets, being one of held and guided at one of one sheet edge and at both sheet edges are guided past the deionization device (8).

9. The method according to claim 8 wherein the sheets are held by grippers of one of revolving and rotating sheet conveyor systems as the sheets are guided past the deionization device.

10. The method according to claim 7, wherein one of an open-loop and a closed-loop control unit is provided for adapting the discharge by the one or more deionization devices (8) to the electrostatic build-up of one of a respective sheet and of a plurality of sheets.

11. The method according to claim 7, wherein a cover (13) with or without openings is used to create a sheet guide surface at the deionization device (8) as a function of the current job.

12. The method according to claim 7, wherein the sheets are received by a sheet conveyor system (7, 18) from a sheet guide cylinder (5) in at least one unit (2) and/or a delivery (4) of the machine (1) and conveyed in the sheet conveyor direction (BFR) on a sheet conveyor path, the sheets being guided by a sheet guide element (9) arranged beneath and along the sheet conveyor path, the sheets first being guided at a sheet guide surface of the sheet guide element (9) which comprises a deionization device (8) and is spaced further apart from an axis of rotation of the assigned sheet conveyor system (7, 18) than a sheet guide surface of the sheet guide element (9) that adjoins in the sheet conveyor direction (BFR).

13. The method according to claim 12, one of wherein the sheets are peeled off the lateral surface of the sheet guide cylinder (5) by comb fingers (10) of the sheet guide element (9), which starts in the region of the sheet guide cylinder (5), and are guided to the deionization device (8) and wherein the sheets, downstream from the deionization device (8), are guided concentrically with respect to the axis of rotation of the sheet conveyor system (7, 18) to a downstream sheet guide cylinder (5).

14. The method according to claim 13 wherein the sheets are peeled off the lateral surface of the sheet guide cylinder (5) by one of pneumatically acting and metallic ones of the comb fingers (10) of the sheet guide element (9).

15. The method according to claim 7, wherein the sheets are conveyed in a plurality of printing units (2) and/or a delivery (4) of the machine (1), the sheets being printed in the printing units (2) in press nips, the sheets being received by a sheet conveyor system (7, 18) from a sheet guide cylinder (5) in the printing units (2) and/or the delivery (4) and conveyed in the sheet conveyor direction (BFR) on a sheet conveyor path, the sheets being guided in the printing units (2) and/or the delivery (4) in each case by a sheet guide element (9), which starts in the region of the sheet guide cylinder (5) beneath and along the sheet conveyor path, and the sheets being guided past a deionization device (8) after each press nip in the printing units (2) and/or the delivery (4).

* * * * *